US008226449B2

(12) United States Patent
Manura et al.

(10) Patent No.: US 8,226,449 B2
(45) Date of Patent: Jul. 24, 2012

(54) METHOD OF MANUFACTURING RHENIUM ALLOY EMISSION FILAMENTS

(75) Inventors: John J. Manura, Ringoes, NJ (US); Christopher W. Baker, Doylestown, PA (US); Ronald E. Shomo, II, Doylestown, PA (US)

(73) Assignee: Scientific Instrument Services, Inc., Ringoes, NJ (US)

( * ) Notice: Subject to any disclaimer, the term of this patent is extended or adjusted under 35 U.S.C. 154(b) by 0 days.

(21) Appl. No.: 13/199,136

(22) Filed: Aug. 19, 2011

(65) Prior Publication Data

US 2011/0306264 A1 Dec. 15, 2011

(51) Int. Cl.
*H01J 9/04* (2006.01)
*H01K 3/02* (2006.01)

(52) U.S. Cl. ..... 445/48; 445/46; 445/49

(58) Field of Classification Search ..... 445/46, 445/48, 49

See application file for complete search history.

(56) References Cited

U.S. PATENT DOCUMENTS

| | | | |
|---|---|---|---|
| 3,318,683 | A | 5/1967 | Foster, Jr. et al. |
| 3,530,327 | A | 9/1970 | Zollweg et al. |
| 3,623,860 | A | 11/1971 | Cheney et al. |
| 3,731,095 | A | 5/1973 | Komoda |
| 3,883,764 | A | 5/1975 | Johnson et al. |
| 3,916,202 | A | 10/1975 | Heiting et al. |
| 3,984,692 | A | 10/1976 | Arsenault |
| 3,988,629 | A | 10/1976 | White et al. |
| 4,045,247 | A | 8/1977 | Morris |
| 4,117,374 | A | 9/1978 | Witting |
| 4,367,429 | A | 1/1983 | Wang et al. |
| 4,540,884 | A | 9/1985 | Stafford et al. |
| 4,599,869 | A | 7/1986 | Ozin et al. |
| 4,994,711 | A | 2/1991 | Matossian |
| 5,028,791 | A | 7/1991 | Koshiishi et al. |
| 5,084,606 | A | 1/1992 | Bailey et al. |
| 5,220,167 | A | 6/1993 | Brown et al. |
| 5,493,115 | A | 2/1996 | Deinzer et al. |
| 5,506,412 | A | 4/1996 | Buttrill, Jr. |
| 5,543,625 | A | 8/1996 | Johnson et al. |
| 5,756,996 | A | 5/1998 | Bier et al. |
| 6,060,829 | A | 5/2000 | Kubon et al. |
| 6,162,552 | A | 12/2000 | Bewlay et al. |
| 6,359,386 | B1 | 3/2002 | Von Morgen et al. |
| 6,404,130 | B1 | 6/2002 | Dinter |
| 6,749,803 | B2 | 6/2004 | Adams |
| 6,812,626 | B2 | 11/2004 | Perlo et al. |
| 6,821,313 | B2 | 11/2004 | Adams |
| 6,979,818 | B2 | 12/2005 | Scheidemann et al. |
| 7,185,527 | B2 | 3/2007 | Lin |

(Continued)

*Primary Examiner* — Joseph L Williams
(74) *Attorney, Agent, or Firm* — Sperry, Zoda & Kane

(57) ABSTRACT

A new Rhenium alloy usable for improving the performance of emission filaments used in mass spectrometers or other similar scientific instruments, which is made by adding low level concentrations of Yttrium Oxide to Rhenium of less than 10%. This new alloy has demonstrated superior performance characteristics compared to pure Rhenium for this purpose. Filaments made from the Yttria/Rhenium alloy exhibit the same voltage, current and emission properties as Rhenium but have the added advantage of greatly decreasing warping during use. The Rhenium alloy filaments are usable with various shapes and configurations including straight filaments, multiple coiled filaments and pin shaped filaments. Electron microscopy and microscopy studies verify that the Yttria/Rhenium material of the new alloy has a smaller grain size and increased strength when compared to pure Rhenium, which accounts for the enhanced structural strength.

7 Claims, 2 Drawing Sheets

U.S. PATENT DOCUMENTS

| | | | |
|---|---|---|---|
| 7,235,796 | B2 | 6/2007 | Kolodney et al. |
| 7,247,495 | B2 | 7/2007 | Amirav |
| 7,270,782 | B2 | 9/2007 | Adams |
| 7,309,860 | B2 | 12/2007 | Baba et al. |
| 7,329,864 | B2 | 2/2008 | Wang |
| 7,442,920 | B2 | 10/2008 | Scheidemann et al. |
| 7,460,225 | B2 | 12/2008 | Karanassios |
| 7,462,824 | B2 | 12/2008 | Wang |
| 7,485,873 | B2 | 2/2009 | Ward et al. |
| 2005/0238522 | A1 | 10/2005 | Leonhardt et al. |
| 2010/0019142 | A1 | 1/2010 | Mannino et al. |

METHOD OF MANUFACTURING RHENIUM ALLOY EMISSION FILAMENTS

The present utility application hereby formally claims priority of U.S. Provisional Patent application No. 61/215,028 filed Apr. 30, 2009 on "Emission Filament of a Rhenium Alloy" filed by the same inventors listed herein as inventors of the following application, namely, John J Manura, Christopher W. Baker and Ronald E. Shomo, II, and assigned to the same assignee, namely Scientific Instrument Services, Inc., wherein said referenced provisional application is hereby formally and fully incorporated by reference for all reasons, including but not limited to supplementing the disclosure set forth in the below application, and should be deemed to be an integral part of the following present application.

The present utility application also formally claims priority of currently pending United States utility patent application Ser. No. 12/661,786 filed Mar. 24, 2010 on "Emission Filaments Made From A Rhenium Alloy And Method Of Manufacturing Thereof" filed by the same inventors, namely, John J. Manura, Christopher W. Baker and Ronald E. Shomo, II and assigned to the same assignee, namely, Scientific Instrument Services, Inc., wherein said referenced utility application is hereby formally and fully incorporated by reference for all reasons, including but not limited to supplementing the disclosure set forth in the below application, and should be deemed to be an integral part of the following present application.

BACKGROUND OF THE INVENTION

1. Field of the Invention

In most prior applications, emission filaments used in scientific instruments have been constructed from pure Rhenium with purity levels exceeding 99.99%. Rhenium has been the material of choice due to a basic resistance to oxidation and good emission qualities. However, Rhenium has also presented a few unique problems and other issues over the many years of usage thereof as emission filaments. Rhenium tends to be quite a soft material and has a tendency to warp or otherwise deform during emission especially when experiencing elevated temperatures. This characteristic can present a problem for various scientific instruments where the focal point of the electron beam generated by the filament is quite critical and any movement of the filament causes a decrease in the sensitivity of the beam and, consequently, a decrease in the sensitivity of the scientific instrument.

Previously most filaments have also been made from tungsten or from an alloy of tungsten such as 97% tungsten and 3% Rhenium. Although these alloys are still being used in some instruments, many manufactures have refrained from using such tungsten alloys due to the tendency of rapid oxidation of the tungsten in the presence of any traces of oxygen in the environment resulting in the formation of significant accumulations of tungsten oxide on the surfaces of the filaments which severely compromises operation.

2. Description of the Prior Art

Many patents have been granted detailing various configurations of emission filaments for use in scientific instruments such as shown in U.S. Pat. No. 3,318,683 patented May 9, 1967 to E. L. Foster, Jr. et al and assigned to Battelle Development Corporation on a "Refractory Metal Powders"; and U.S. Pat. No. 3,530,327 patented Sep. 22, 1970 to R. J. Zollweg et al and assigned to Westinghouse Electric Corporation on "Metal Halide Discharge Lamps With Rare-Earth Metal Oxide Used As Electrode Emission Material"; and U.S. Pat. No. 3,623,860 patented Nov. 30, 1971 to R. F. Cheney et al and assigned to GTE Sylvania Incorporated on a "Tungsten-Rhenium Alloy Powder"; and U.S. Pat. No. 3,731,095 patented May 1, 1973 to T. Komoda and assigned to Hitachi, Ltd. on an "Electron Gun Device Of Field Emission Type"; and U.S. Pat. No. 3,916,202 patented Oct. 28, 1975 to R. F. Heiting et al and assigned to General Electric Company on a "Lens-Grid System For Electron Tubes"; and U.S. Pat. No. 3,984,692 patented Oct. 5, 1976 to G. P. Arsenault and assigned to Massachusetts Institute of Technology on an "Ionization Apparatus And Method For Mass Spectrometry"; and U.S. Pat. No. 3,988,629 patented Oct. 26, 1976 to J. E. White et at and assigned to General Electric Company on a "Thermionic Wick Electrode For Discharge Lamps"; and U.S. Pat. No. 4,045,247 patented Aug. 30, 1977 to J. F. Morris and assigned to The United States of America as represented by the Administrator of the National Aeronautics and Space Administration on a "Thermocouples Of Tatalum And Rhenium Alloys For More Stable Vacuum-High Temperature Performance"; and U.S. Pat. No. 4,367,429 patented Jan. 4, 1983 to V. Wang et al and assigned to Hughes Aircraft Company on "Alloys For Liquid Metal Ion Sources"; and U.S. Pat. No. 4,540,884 patented Sep. 10, 1985 to G. C. Stafford et al and assigned to Finnigan Corporation on a "Method Of Mass Analyzing A Sample By Use Of A Quadrupole Ion Trap"; and U.S. Pat. No. 4,599,869 patented Jul. 15, 1986 to G. A. Ozin et al on a "Cryogenic Deposition Of Catalysts"; and U.S. Pat. No. 4,994,711 patented Feb. 19, 1991 to J. N. Natossian and assigned to Hughes Aircraft Company on a "High Brightness Solid Electrolyte Ion Source"; and U.S. Pat. No. 5,028,791 patented Jul. 22, 1991 to A. Koshiishi et al and assigned to Tokyo Electron Ltd. on an "Electron Beam Excitation Ion Source"; and U.S. Pat. No. 5,084,606 patented Jan. 28, 1992 to J. M. Bailey et al and assigned to Caterpillar Inc. on an "Encapsulated Heating Filament For Glow Plug"; and U.S. Pat. No. 5,220,167 patented Jun. 15, 1993 to L. Brown et al and assigned to Carnegie Institution of Washington on a "Multiple Ion Multiplier Detector For Use In A Mass Spectrometer"; and U.S. Pat. No. 5,493,115 patented Feb. 20, 1996 to M. L. Deinzer et al and assigned to The State of Oregon acting by and through the State Board of Higher Education on behalf of Oregon State University on "Methods For Analyzing A Sample For A Compound Of Interest Using Mass Analysis of Ions Produced By Slow Monochromatic Electrons"; and U.S. Pat. No. 5,506,412 patented Apr. 9, 1996 to S. E. Buttrill, Jr. on a "Means For Reducing The Contamination Of Mass Spectrometer Leak Detection Ion Sources"; and U.S. Pat. No. 5,543,625 patented Aug. 6, 1996 to B. S. Johnson et al and assigned to Finnigan Corporation on a "Filament Assembly for Mass Spectrometer Ion Sources"; and U.S. Pat. No. 5,756,996 patented May 26, 1998 to M. E. Bier et al and assigned to Finnigan Corporation on an "Ion Source Assembly For An Ion Trap Mass Spectrometer And Method"; and U.S. Pat. No. 6,060,829 patented May 9, 2000 to M. Kubon et at and assigned to U.S. Philips Corporation on a "Metal Halide Lamp With Rhenium Skin On Tungsten Electrode"; and U.S. Pat. No. 6,162,552 patented Dec. 19, 2000 to B. P. Bewlay et at and assigned to General Electric Company on a "Rhenium-Coated Tungsten-Based Alloy And Composite Articles And Method Therefor"; and U.S. Pat. No. 6,359,386 patented Mar. 19, 2002 to G. L. Von Morgen et al and assigned to U.S. Philips Corporation on an "Electric Lamp With Metal Shell"; and U.S. Pat. No. 6,404,130 patented Jun. 11, 2002 to R. J. Dinter and assigned to Patent-Treuhand-Gesellschaft fuer elektrische Gluehlampen mbH on a "Metal Halide Lamp With Fill Efficient Two-Part Lead-Through"; and U.S. Pat. No. 5,749,803 patented Jun. 15, 2004 to R. J. Adams and assigned to Honeywell International, Inc.

on "Oxidation Resistant Rhenium Alloys"; and U.S. Pat. No. 6,812,626 patented Nov. 2, 2004 to P. Perlo et al and assigned to C.R.F. Scoieta Consortile per Azioni on "Light Source With Matrix Of Microfilaments"; and U.S. Pat. No. 6,821,313 patented Nov. 23, 2004 to R. J. Adams and assigned to Honeywell International, Inc. on Reduced Temperature And Pressure Powder Metallurgy Process For Consolidating Rhenium Alloys"; and U.S. Pat. No. 6,979,818 patented Dec. 27, 2005 to A. A. Scheidemann et al and assigned to OI Corporation on a "Mass Spectrometer For Both Positive And Negative Particle Detection"; and U.S. Pat. No. 7,185,527 patented Mar. 6, 2007 to B. Lin and assigned to Agilent Technologies, Inc. on "Protecting Filaments Of A Thermal Conductivity Detector"; and U.S. Pat. No. 7,235,796 patented Jun. 26, 2007 to E. Kolodney et al and assigned to Technion Research & Development Foundation Ltd. on a "Method And Apparatus for The Generation Of Anionic And Neutral Particulate Beams And A System Using Same"; and U.S. Pat. No. 7,270,782 patented Sep. 18, 2007 to R. J. Adams and assigned to Honeywell International, Inc. on a "Reduced Temperature And Pressure Powder Metallurgy Process For Consolidating Rhenium Alloys"; and U.S. Pat. No. 7,247,495 patented Jul. 24, 2007 to A. Amirav on a "Mass Spectrometer Method And Apparatus For Analyzing A Sample In A Solution"; and U.S. Pat. No. 7,309,860 patented Dec. 18, 2007 to T. Baba et al and assigned to Hitachi High-Technologies Corporation on a "Mass Spectrometer"; and U.S. Pat. No. 7,329,864 patented Feb. 12, 2008 to Y. Wang on "Mass Spectrometry With Multiple Ionization Sources And Multiple Mass Analyzers"; and U.S. Pat. No. 7,442,920 patented Oct. 28, 2008 to A. A. Scheidemann et al and assigned to O. I. Corporation on an "Optical Bench For A Mass Spectrometer System"; and U.S. Pat. No. 7,460,225 patented Dec. 2, 2008 to V. Karanassios on "Miniaturized Source Devices For Optical And Mass Spectrometry"; and U.S. Pat. No. 7,462,824 patented Dec. 9, 2008 to Y. Wang on a "Combined Ambient Desorption And Ionization Source For Mass Spectrometry"; and U.S. Pat. No. 7,485,873 patented Feb. 3, 2009 to B. W. Ward et al and assigned to ALIS Corporation on "Ion Sources, Systems And Methods"; and United States Publication No. 2005/0238522 published Oct. 27, 2005 to T. A. Leonhardt et al and assigned to Rhenium Alloys, Inc. on "Binary Rhenium Alloys".

SUMMARY OF THE INVENTION

The present invention provides a filament usable as an emission source in a scientific instrument usable such as for electron beams or for focused energy beams. The filament is formed from an alloy of Rhenium and Yttrium Oxide where the Yttrium Oxide comprises from 0.01% to 10% volume percent of the final alloy. This alloy so formed of Rhenium and Yttrium Oxide actually is formed as a Yttrium Oxide coated Rhenium powder wherein the alloy has a finer grain structure than generally pure Rhenium in order to enhance rigidity, strength and creep resistance.

The filament is manufactured by providing Rhenium powder and Yttria initially in the form of Yttrium Nitrate having a formula Y(NO3)3*6H2O. The Rhenium is then refined while simultaneously sintering the Yttria into the Rhenium to form a refined Rhenium and Yttrium Oxide alloy material. The Yttria is sintered into the Rhenium powder sufficiently during refining thereof to provide 0.01% to 10% volume percent Yttrium Oxide in the final alloy. This refining and sintering forms the Rhenium and Yttrium Oxide alloy wherein the Yttrium Oxide is positioned coating the Rhenium powder to provide the overall concentration as specified above. This final alloy has a final crystalline grain size finer or smaller than is present within generally pure Rhenium in order to enhance rigidity, strength and creep resistance of the material. Finally the Rhenium alloy is drawn down into a wire form for use in making various configurations of emission filaments.

It is an object of the emission filament of the present invention to provide a unique Rhenium alloy from which an emission filament may be formed which resists warping.

It is an object of the emission filament of the present invention to provide a unique Rhenium alloy from which an emission filament may be formed which resists deformation of any kind during normal operating conditions.

It is an object of the emission filament of the present invention to be usable in a variety of different shapes, sizes and configurations.

It is an object of the emission filament of the present invention to be useful as a straight wire filament, single coil or multiple coil filament and/or pin-shaped filament for various applications.

It is an object of the emission filament of the present invention to be particularly useful in mass spectrometers.

It is an object of the emission filament of the present invention to be usable in electron microscopes.

It is an object of the emission filament of the present invention to be usable in X-ray surface analysis systems.

It is an object of the emission filament of the present invention to be useful in various types of scientific instruments and systems which can be made from a Rhenium alloy which includes no greater than 10% Yttria.

BRIEF DESCRIPTION OF THE DRAWINGS

While the invention is particularly pointed out and distinctly described herein, a preferred embodiment is set forth in the following detailed description which may be best understood when read in connection with the accompanying drawings, in which.

Rhenium filaments and Y/Re alloy filaments in milliamps shown versus the filament current in amps.

DETAILED DESCRIPTION OF THE PREFERRED EMBODIMENT

Figure 1:
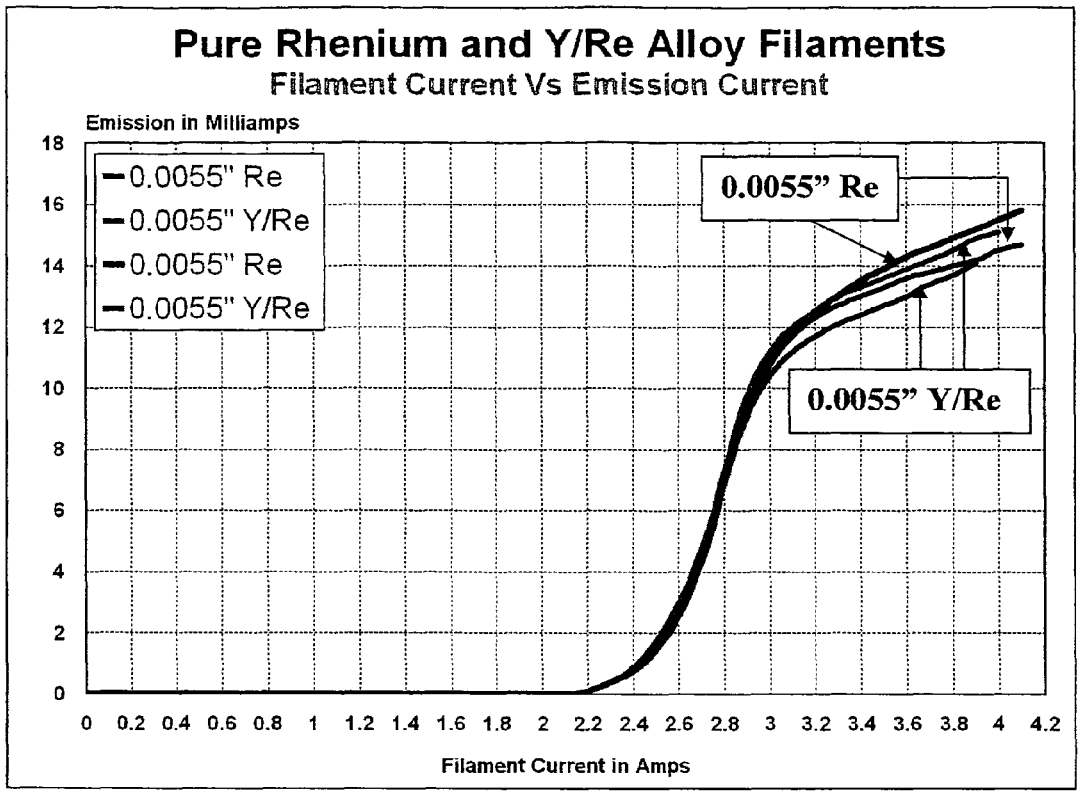
FIG. 1 is a graph illustrating the emission characteristics of pure

During the researching leading to the discovery of the present invention, filaments of a variety of different shapes, size and configurations were tested including straight wires, single or multiple coils and pin shaped filaments for each of the various tested alloys to compare their electrical and physical properties.

As clearly shown in the studies detailed herewithin, the warping of the filaments has been eliminated when formed using the unique alloy of the present invention. The use of the Yttria/Rhenium alloy of the present invention permits the construction of filaments in a variety of shapes and configurations that will not warp or change shape under normal operating conditions and will therefore provide longer overall average filament life. This major improvement in filament technology greatly increases filament lifetimes when used in mass spectrometers, leak detectors, electron microscopes, X-Ray surface analysis systems and other scientific instruments and systems that make use of such emission filaments for the production of electron beams or focused energy beams.

This alloy of Rhenium of the present invention is formed by sintering Yttria into Rhenium as part of the refining process. By sintering the Yttria into the Rhenium, the resulting grain structure and grain boundaries of the Rhenium wire become purposefully altered. This unique process results in a filament that maintains the inherently good emission qualities of Rhenium but is stronger with a longer useful life because it does not sag or warp like pure Rhenium filaments. During the research leading to the development of the present invention, various Rhenium/Yttria alloys of somewhat different relative concentrations have been sintered and drawn down into small diameter wires to facilitate analysis and comparison of these filaments to the standard Rhenium filaments. The concentration of Yttria within the various studies detailed herebelow will range generally from 0.01% to 10% Yttria in Rhenium. The development and testing of these novel alloys was performed in a custom proprietary filament testing station developed specifically for the purpose of testing of such filaments. Subsequent testing was done in several phases using various different mass spectrometers to verify the generic nature of the results.

The custom filament testing station included a vacuum chamber having certain important main features. Initially the vacuum is achieved with a rough pump and a turbo pump to achieve a vacuum level of between $2.0\times10^{-6}$ and $1.0\times10^{-7}$ torr. This vacuum level is the normal operational vacuum level utilized in most mass spectrometers.

The testing station has a number of positions to allow insertion of as many as 10 filaments simultaneously into the vacuum chamber. A custom plate with a custom filament mounting jig permits the insertion of the filaments next to a collector plate. A view plate is included in order to permit the viewing of the filaments and more easily permit the photographing of the filaments during testing.

Three separate power supplies permit the analysis of three filaments simultaneously. Each power supply permits the adjustment of the filament power to either a constant current mode or a constant voltage mode for testing purposes. In testing of filament current, filament voltage and filament emission, each was measured using digital meters with accuracy measurable to three digits.

A separate power supply was utilized to maintain an emission voltage between the filament and collector at 70 volts. A three digit amp meter is included in this circuit for the purpose of measuring the emission current.

A special jig was constructed to hold and orient each of the filaments so that they could be more easily be observed through a plexiglass window in the testing station to facilitate taking photographs of the filaments during operation to monitor any changes in filament shape as well as the physical appearances of the filament.

The filament holder or press was constructed from a stainless steel block into which two stainless steel filament posts were fritted to electrically isolate the filament posts from the stainless steel block. The Rhenium or Yttria/Rhenium filament being tested was spot-welded to the posts. In some instances a reflector or shield was welded to one of the posts. When testing a pin-shaped filament, a cap or plated with a hole in the center was welded to one of the filament posts to enable the accurate determination as to any filament movement during its operation.

To assure accuracy several studies were conducted on each of the filaments tested. Physical properties were studied during testing wherein each of the filaments was ramped up in 0.10 amp increments and the resulting filament current, filament voltage and emission current were recorded. This testing was performed to determine the normal operating parameters of the filaments and to compare their electrical and physical properties.

Studies were conducted specifically to analyze various parameters of each filament including lifetime, warping and operation. For each of the studies the filament current was regulated to the desired current value. Each filament was cycled on for 50 seconds then turned off for 20 seconds. Filament current and voltage were recorded every 100 cycles during the weekday running of the filament, but not during the evenings when the system continued to run unattended. Photographs of the filament during testing were taken at each recording of the filament voltage and current. This cycle was repeated and the cycles were counted until the filament burned out or reached a predetermined number of cycles. The number of cycles was automatically counted by the computer which also controlled the cycling operations. These studies were performed to compare the physical characteristics of the filaments and to determine the comparative lifetimes of each tested filament.

A number of different filaments shapes were studied. Initial experiments were performed with straight filament wires. Additional studies were conducted with multiple coil shaped filaments and then with pin shaped filaments to provide a comprehensive study of the degree of warping which is prevalent in these filaments when they are constructed from pure Rhenium.

The Yttria/Rhenium alloy material was manufactured using various specific materials and procedures. A significant amount of pure Rhenium powder and Yttrium nitrate, Y(NO3)3.6H2O, were used to produce Yttria-coated Rhenium powder having overall concentrations of Yttria ranging between 0.01% and 10%. This Yttria-dispersed alloy was measured in terms of volume percent of the second phase, Yttrium Oxide. This alloy ratio is expressed in accordance with typical nomenclature currently utilized for other similar alloys. The additions were dissolved in water, dried and reduced in a hydrogen furnace. The green pressed bars were then sintered to form the alloy bars. The sintered alloy bars were then drawn to the required diameters for the following studies and for use as filaments.

Studies on Straight Wire Filaments—The filament holders (filament presses) were constructed from a stainless steel block into which two stainless steel filament posts were fritted to electrically isolate the filament posts from the stainless steel block. The Rhenium or Yttria/Rhenium filament was spot-welded to the posts. Straight wire filaments were made from and 0.0055" diameter Rhenium. Straight wire filaments were also made from the 0.0055" diameter of the Rhenium/Yttria alloy.

Standard Filament and Filament Press Design of the Filament Studies—The filaments were placed into the proprietary testing station and pumped down overnight to 1.0×10−6 torr. Photographs of each of the filaments were taken before any testing was begun. Each filament was slowly ramped up until an emission current of about 0.5 mA was observed and the filament was held there until the filament emission stabilized. This ramping and stabilizing step was performed in order to condition the filaments before additional testing was started and to finalize the crystal structure of the filament at the center where heat is the greatest. The filaments were then turned off.

Each filament was slowly ramped up in increments of 0.10 mA of filament current until the filament burned out. At each 0.10 mA increment of filament current, the filament current and emission current were recorded. At the end of each filament cycle, a photograph was again taken of each burned out filament. The above procedure was repeated for each different dimension and style of filament.

Figure 2:
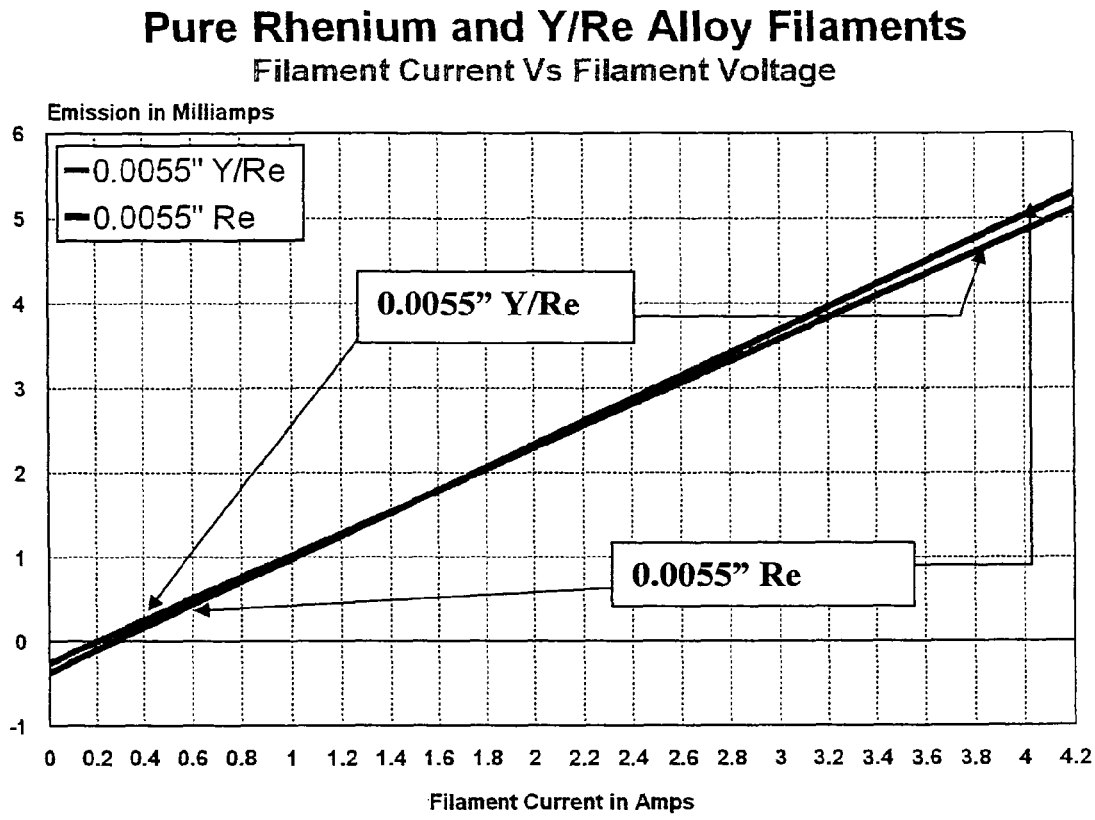
FIG. 2 a graph illustrating filament current versus the filament voltage for pure Rhenium and Y/Re alloy filaments.

The filament current was plotted against the emission current for two sets of the 0.0055: Re and Y/Re filaments as shown in FIG. 1. The emission current as a function of filament current was nearly identical for both the pure Rhenium filament and for the Yttria/Rhenium filament. In addition to the current and emission characteristics, the voltage characteristics of both the pure Rhenium as well as the Yttria/Rhenium were nearly identical and shown in FIG. 2. The nearly identical physical and electrical properties of the Yttria/Rhenium material permit this alloy to be used interchangeably with any instrumentation that uses pure Rhenium filaments.

Studies on Two Coil Filaments—Yttria/Rhenium alloy two coil filaments and pure Rhenium two coil filaments were constructed on a filament press with the addition of a filament shield behind the filament wire. The two coil filaments were made from 0.0055" diameter wire of the Yttria/Rhenium alloy or of pure Rhenium.

Two of the new alloy Yttria/Rhenium alloy two coil filaments and two of the pure Rhenium two coil filaments were mounted into the proprietary testing station. This testing used a DC supply to analyze and compare the voltage, current, power and emission characteristics of these filaments. The filament current was ramped up in 0.1 amp increments and the filament current, voltage and filament emission current (at 70 volts) were recorded until the filament burned out.

A comparison of the ability of the filaments to achieve a relative emission of 3.0 milliamps is listed in the chart below.

| | Voltage Current Power Emission | | | |
|---|---|---|---|---|
| Filament | Volts | Amps | Watts | milliamps |
| Rhenium - 2 Coil | 3.4 | 3.15 | 10.7 | 3.0 |
| Yttria/Rhenium - 2 Coil | 3.3 | 3.10 | 10.2 | 3.0 |

As demonstrated above, the physical and electrical properties of the two coil Yttria/Rhenium filament is nearly identical to the properties of the pure two coil Rhenium filaments Additional filaments were then lifetime analyzed following the standard lifetime procedures outlined previously. The filaments were cycled on and off until the filaments failed at which time the number of cycles at burnout was recorded. The filaments burned out as follows:

| | |
|---|---|
| SIS Yttria/Rhenium Filament - #1 | 2285 Cycles |
| SIS Yttria/Rhenium Filament - #2 | 2307 Cycles |
| SIS Yttria/Rhenium Filament - #3 | 1990 Cycles |
| SIS Yttria/Rhenium Filament - #4 | 1824 Cycles |
| Rhenium Filament #1 | 2710 Cycles |
| Rhenium Filament #2 | 3300 Cycles |
| Rhenium Filament #3 | 1900 Cycles |
| Rhenium Filament #4 | 2120 Cycles |

Photographs of the burned out Yttria/Rhenium filaments were taken at 20× and 400× magnifications. From observations it is noteworthy that no warping of these filaments occurred while filament life was not significantly improved. This lack of warping has been attributed to the crystal structure and grain size change caused by the addition of the Yttria doping component into the Rhenium material. Further SEM testing has been conducted to further evaluate this study. It is important to note that the two coil filaments that were run under the same conditions but constructed from 0.0055" pure Rhenium exhibited significant warping.

These studies verify the enhanced performance of the Yttria/Rhenium alloy for use as emission filaments for mass spectrometers and other similar scientific instruments. The enhanced properties attributed to the addition of Yttria to the Rhenium alter the crystal structure of the Rhenium and result in the elimination of sagging and warping of the filaments under conditions of normal usage. This enhancement permits the use of this alloy to produce not only straight wire and ribbon shaped filaments but also multiple coil shaped filaments and other shapes of filaments that are more stable and less likely to warp or change shape when used at elevated temperatures.

Studies on 3 Coil Filaments—Additional testing was conducted on three coil filaments constructed from Rhenium wire and Yttria/Rhenium alloy wire each having a diameter of 0.003".

For this first study a Yttria/Rhenium filament was operated at a constant filament current of 0.90 amps DC in the proprietary testing station. The filament was cycled ON for 60 seconds and then OFF for 20 seconds. Filament current, filament voltage and emission current were measured. Archival photographs were taken of the filament when the filament was in the OFF cycle.

It is important to note that the emission filament as observed does not appear to have moved or warped at all. When compared with the standard pure Rhenium filament tested, the difference was clearly evident.

This minimizing of warping is in agreement with other studies we have performed on other style filaments which were tested in with the proprietary testing station described herein as well as in a mass spectrometer. This data was subsequently verified by repeating the tests in a mass spectrometer.

A sample of the data from one of the Yttria/Rhenium filaments is listed below. The filament exhibited a longer life than the standard pure Rhenium filament tested subsequently.

| | Current Voltage Emission | | |
|---|---|---|---|
| Cycles | (DC Amps) | (DC Volts) | (milliamps) |
| 1 | 0.90 | 2.44 | 0.3 |
| 500 | 0.90 | 2.40 | 0.3 |
| 1000 | 0.90 | 2.40 | 0.3 |
| 3000 | 0.90 | 2.42 | 0.3 |
| 4000 | 0.90 | 2.47 | 0.4 |
| 4500 | 0.90 | 2.47 | 0.5 |
| 4900 | 0.90 | 2.50 | 0.6 |
| 5000 | 0.90 | 2.50 | 0.7 |
| 5200 | 0.90 | 2.53 | 0.7 |
| 5300 | 0.90 | 2.59 | 0.7 |
| 5500 | 0.90 | 2.63 | 0.8 |
| 5600 | 0.90 | 2.60 | 0.8 |
| 5700 | 0.90 | 2.64 | 0.9 |
| 5800 | 0.90 | 2.68 | 1.1 |
| 5900 | 0.90 | 2.77 | 1.3 |
| 5950 | 0.90 | 2.78 | 1.5 |
| 5980 | 0.90 | 3.06 | 1.8 |

Photographs were taken show the two separate Yttria/Rhenium filaments after burnout at 20× and 400× magnification. Careful observation indicates that even though the filament failed due to burnout, the remaining coils of the filament did not change shape or warp. This result agrees with the previous studies done on the straight wire and two coil filaments.

Coil Yttria/Rhenium Alloy Filaments at burnout—Magnification at 20× and 400× of the burned out pure Rhenium three coil filaments were photographed and carefully observed and indicate that the filaments do show some sideward movement and a break in the middle of the filament where it would be the hottest. The burnout pattern indicates excessive current going through the filament. These filaments demonstrate significant warping as compared to the Yttria/Rhenium filaments described above.

These studies again verify the enhanced performance of the Yttria/Rhenium alloy when used as filaments for mass spectrometers and other similar scientific instruments. The enhanced properties attributed to the addition of Yttria to the Rhenium alter the crystal structure of the Rhenium and result in the elimination of sagging and warping of the filaments. These results indicate the advantages that permit the use of this alloy to produce not only straight wire and ribbon shaped filaments but also multiple coil shaped filaments and other shapes of filaments that are more stable and less likely to warp or change shape when used at elevated temperatures.

Studies on the Pin Shaped Filaments—Pin shaped filaments were made from 0.004" diameter Yttria/Rhenium alloy wire and also 0.004" diameter pure Rhenium wire. The pin shaped filament was centered in a circular shield opening in order to verify the movement of the filament in any direction. The filaments were then put into the testing station and vacuum pumped for about 4 hours down to around $1.0\times10^{-6}$ torr before testing was started. Each filament was cycled on for 50 seconds then turned off for 20 seconds.

For this first study, the filament current was set to 1.6 amps DC. The filament current and voltage were regularly recorded. This cycle was repeated and the number of cycles counted until the filament burned out at 4,610 cycles. Although the filament began to thin out at 4600 cycles, the Yttria/Rhenium filament did not move or warp.

The following chart plots the results of these experiments.

Filament BA2 - Rhenium Allow 1 filaments at 1.6 amps

| Cycles | CurrentVoltage | Notes |
|---|---|---|
| 1 | 1.6 | 2.38 |
| 100 | 1.6 | 2.47 |
| 500 | 1.6 | 2.42 |
| 3000 | 1.6 | 2.43 |
| 3500 | 1.6 | 2.45 |
| 4000 | 1.6 | 2.44 |
| 4500 | 1.6 | 2.49 |
| 4600 | 1.6 | 2.64 |
| 4610 | 1.6 | Filament Burned Out |

For this second study the filament current was set to 1.5 amps DC. Each filament was cycled on for 50 seconds then turned off for 20 seconds. The filament current and voltage were regularly recorded. This cycle was repeated and the number of cycles counted. The filament testing continued until the filament failed at 33,000 cycles. No visible warping of the Yttria/Rhenium pin shaped filament was observed in these tests. The following chart plots the results of these experiments.

Filament BA2 - Rhenium Alloy 1 filaments at 1.5 amps

| Cycles | Current Voltage | Notes |
|---|---|---|
| 1 | 1.5 | 2.42 |
| 100 | 1.5 | 2.23 |
| 1,000 | 1.5 | 2.12 |

-continued

Filament BA2 - Rhenium Alloy 1 filaments at 1.5 amps

| Cycles | Current Voltage | Notes |
|---|---|---|
| 2,000 | 1.5 | 2.11 |
| 3,000 | 1.5 | 2.10 |
| 4,000 | 1.5 | 2.13 |
| 8,000 | 1.5 | 2.20 |
| 9,000 | 1.5 | 2.21 |
| 10,000 | 1.5 | 2.23 |
| 12,000 | 1.5 | 2.23 |
| 14,000 | 1.5 | 2.22 |
| 15,500 | 1.5 | 2.20 |
| 20,000 | 1.5 | 2.20 |
| 25,000 | 1.5 | 2.20 |
| 26,000 | 1.5 | 2.20 |
| 30,000 | 1.5 | 2.20 |
| 33,000 | 1.5 | 2.20 |

The Yttria/Rhenium alloy pin shaped filaments did not demonstrate any warping or change in shape as was observed in the standard Rhenium filament. The reason for this enhancement was evidenced by the SEM analysis of the cross sections of both the standard Rhenium and Yttria/Rhenium filaments detailed herein. The Rhenium alloy wire possesses a finer grain structure, which appears to have increased the rigidity characteristics thereof. The Yttria/Rhenium alloy filament operates at nearly the same voltage and current and achieves the same emission intensity as the pure Rhenium, as was demonstrated in testing of both the straight wire and the coil shaped filaments.

Pin shaped filaments were made from 0.004" pure Rhenium to conduct a comparison study. Archival photographs were taken of the filaments after burnout. Significant warping of these filaments was observed.

Pure Rhenium Filaments in the testing station—These studies again verify the enhanced performance of the Yttria/Rhenium alloy for use as filaments for mass spectrometers and other scientific instruments. The enhanced properties resulting from the addition of Yttria to the Rhenium alter the crystalline structure of the Rhenium and result in the elimination of sagging and warping of the filaments under normal operating conditions. This enhancement permits the use of this alloy to produce not only straight wire and ribbon shaped filaments but also coil shaped filaments and other shapes of filaments that demonstrate more stability and less likelihood to warp or change shape when used at elevated temperatures.

Microscopy and Electron Microscopy Studies—The microstructure of one Yttria/Rhenium filament that fractured during cyclic tests was examined in detail using optical microscopy. The Yttria dispersion produced a much finer grain size, which provided increased strength and creep resistance. This finer grain size greatly improved the dimensional stability of the filament. In addition, the dispersion nearly tripled the cycles to failure compared to a pure Rhenium filament made from the same Rhenium powder lot. It is hypothesized that this improvement is related to the increased grain boundary area associated with the Yttria/Rhenium filaments, as well as the additional interfacial area associated with the particle/matrix boundaries. The increase in interfacial area (grains and particles) provides more area for vacancies to accumulate thereby reducing the rate of pore growth and providing longer times to failure.

Materials and Procedure—Two Yttria/Rhenium filaments were examined after testing to failure in the proprietary cyclic test instrument. Both filaments were identified as "two turn" filaments, 0.0055' diameter Yttria/Rhenium. The table below summarizes additional ID and performance information.

| ID | NSL | Sample Tag ID | Cycles to Failure |
|---|---|---|---|
| 1 | 18469 | 1007 | 2285 |
| 2 | NS(b) | 1008 | 2307 |

Sample 2 was disassembled, mounted, and polished for metallographic examination of the microstructure. For comparison, the metallographic mount prepared for Filament ID TO-J, made from the most recent lot of Rhenium powder, was re-examined to compare its microstructure with those observed in the Yttria/Rhenium filaments (J. A. Shields, "SEM and Optical Examinations of Filament Samples DDDD, AFAF, 1992, and TO-J," Report to SIS (Oct. 16, 2007). Filament TO-J failed after only 800 cycles, which is a number lower than experienced on filaments made from the previous lot of powder, which had cyclic lives of approximately 1500 cycles. This comparison allows an assessment of only the effect of doping, since the Rhenium powder used in the doped alloy is the same as that used to produce filament TO-J.

The stainless steel power leads were cut short, removing the alumina spacer, reflector, and ID tag from the assembly. This procedure allowed the individual fractured segments to be mounted independently, so the metallographic mount contained only the filament and a short length of power lead. The samples were mounted in conductive compression mounting media, were thereafter ground, and finally precision polished to reveal the microstructure in both the Re lead wire and the coil. Because of the coil geometry, it was not possible to obtain "true" transverse sections with certainty. This inability made little difference because the wire microstructure was equiaxed, a result of the cumulative annealing during manufacturing and annealing during operation.

Micrographs were taken and observations were made in both the etched and unetched conditions for the new filament. Sample TO-J was not repolished to view unetched structures, but only observed and documented in the etched condition that remained on the sample after prior preparation.

To more completely analyze the test results, the individual filament segments were ground and polished into the plane of the image. Examination was conducted at various levels of magnification. The grains are approximately equiaxed, which resulted from process annealing and exposure during cyclic testing. Internal porosity was observed to exist because of the high-temperature exposures. These structures contain fine "pepper" contrast associated with Yttria dispersoids.

As observed, the apparent wire diameter is smaller than the reference diameter. While there has no doubt been some recession of the wire due to Rhenium evaporation during testing, the main reason the apparent diameter is less than the nominal wire diameter is the fact that the sections are not at the precise wire midplane. The longitudinal section was taken diagonally through the midplane, resulting in narrower ends and a full midsection. Because of this effect, most of the sections as observed showed structures nearer to the surface of the wire than the midplane, and they often show the effects of grain boundary attack and porosity development near the surface of the inner coil diameter.

In order to determine the grain size of the filaments, all sections were photographed at 100×. Images were observed from not only the sections of Filament 2, but also from filament TO-J. Using the comparative method (Standard Test Methods for Determining Average Grain Size," *ASTM E*112-96, American Society for Testing and Materials, West Conshohocken, PA (July 1996) the images were compared with ASTM grain size charts for single-phase untwinned microstructures to estimate a grain size number, from which an average grain diameter was obtained. Table II summarizes the results.

TABLE II

Grain Size Estimated From Microstructures

| Specimen | ASTM Grain Size Number | Avg. Grain Diameter (μm) |
|---|---|---|
| Segment 1 leadwire | 9.0-9.5 | 13-16 |
| Segment 1 coil A | 8.5-9.0 | 16-19 |
| Segment 1 coil B | 8.5-9.0 | 16-19 |
| Segment 2 coil turn | 9.0-9.5 | 13-16 |
| Segment 2 fracture | 9.0-9.5 | 13-16 |
| TO-J lead wire | 7.5-8.0 | 23-27 |
| TO-J coil | 7.0 | 32 |

The low magnification used in the above analysis makes it difficult to see differences in structure, and the small area sampled lends uncertainty, but it is clear from the grain size values in Table II that a major benefit of the Yttria doping is to refine the recrystallized grain size in the filament. There is little difference in the grain size between the lead wire (Segment 1) and the fracture (Segment 2), even though the operating temperature near the fracture must be significantly higher than in the lead wire. By comparison, the grain size in the lead wire of the undoped filament (TO-J) is nearly twice that of either segment of the doped filament, and the grain size in the TO-J coil is nearly three times that of the doped filament irrespective of location.

This stabilization of the grain structure against annealing and grain growth is a significant factor in the dimensional stability of the doped filament. The strengthening imparted by the finer grain size makes the filament more resistant to deformation and failure. The Yttrium Oxide particles may have another role in promoting filament stability. The vacancies created by annealing, which can collect to form voids on grain boundaries and promote failure, must now collect on a larger area of grain boundaries, as well as possibly by the interfaces between Rhenium matrix and Yttria dopant particles. These factors reduce the vacancy concentration at any given location, reducing void sizes and requiring longer times before failure occurs.

Observation was made of the microstructures of the fractured end of Segment 2 and a coil of filament TO-J at higher magnification, where the difference in grain size was apparent. The Yttria particles were observed as a fine "pepper" contrast. Structures of the other areas of Segment 1 and Segment 2 were similar to those described above.

In conclusion the above tests clearly indicated that the filaments prepared from Rhenium doped with Yttrium Oxide displayed significantly longer cyclic test lives than the filaments prepared from pure Rhenium powder while using the same identical Rhenium powder lot. These operational enhancements can be attributed to several important reasons. The dispersed Yttrium Oxide particles in the matrix stabilize the grain size of the wire and eliminate the grain growth observed in the coil region of the pure Rhenium filament. The Yttrium Oxide particles also provide some strengthening and resistance to dislocation climb thereby providing a more dimensionally stable filament that displays less sag than pure Rhenium filaments. The Yttrium oxide particles also help to improve the cyclic life in another way by providing additional interfacial area to act as vacancy sinks during operation, thus reducing the amount of intergranular porosity that forms during the test and increasing the time to failure.

In summary, doping of pure Rhenium with Yttrium Oxide contributes significantly to enhancing various characteristics of emission filaments made therefrom. The use of this alloy tends to impede grain boundary motion which results in finer grain size as well as increasing both short-term tensile strength and creep strength. (This implies that creep deformation is not due to grain boundary sliding). Furthermore, it creates additional grain boundary area thereby providing more area for vacancies to accumulate and slowing the growth of large pores that otherwise would eventually link up and lead to failure.

Additionally this new alloy tends to create additional interface area at the particle/matrix boundary and, thus, provides more area for vacancies to accumulate which slows the growth of large pores that eventually link up and can lead to failure.

Finally, the additional of Yttrium Oxide will strengthen the Rhenium matrix and, in this manner, increase the ability of the matrix to resist dislocation climb and glide during creep thereby producing a more dimensionally stable filament, even up to failure.

While particular embodiments of this invention have been shown in the drawings and description detailed herein, it will be apparent that many changes may be made in the form, arrangement and positioning of the various elements of the combination. In consideration thereof, it should be understood that preferred embodiments of this invention disclosed herein are intended to be illustrative only and not intended to limit the scope of the invention.

We claim:

1. A method of manufacturing of a filament usable as an emission source in a scientific instrument comprising:

A. providing of Rhenium;

B. providing of Yttria;

C. refining the Rhenium while simultaneously sintering the Yttria into the Rhenium to form a refined alloy of Rhenium and Yttrium oxide ; and D. drawing down the formed Rhenium and Yttrium oxide alloy into a wire form for use in making emission filaments having various physical configurations.

2. The method of manufacturing of a filament usable as an emission source in a scientific instrument as defined in claim 1 wherein said step of refining of the Rhenium while simultaneously sintering the Yttria into the Rhenium to form a refined alloy of Rhenium and Yttrium oxide is performed sufficiently to provide 0.01% to 10% volume percent Yttrium oxide in the final alloy.

3. The method of manufacturing of a filament usable as an emission source in a scientific instrument as defined in claim 1 wherein said Yttria as provided initially comprises Yttrium Nitrate, namely, $Y(NO_3)_3.6H_2O$.

4. The method of manufacturing of a filament usable as an emission source in a scientific instrument as defined in claim 1 wherein said Rhenium is provided initially as Rhenium powder.

5. The method of manufacturing of a filament usable as an emission source in a scientific instrument as defined in claim 1 wherein said refining of Rhenium while simultaneously sintering Yttria thereinto includes forming a Yttrium oxide coated Rhenium powder having overall concentrations of Yttrium oxide ranging between 0.01% and 10% of the final alloy.

6. The method of manufacturing of a filament usable as an emission source in a scientific instrument as defined in claim 1 wherein Yttrium oxide is sintered into the Rhenium sufficiently and in such a manner as to form an final alloy of Rhenium and Yttrium oxide having an average grain size that is smaller than the grain size of generally pure Rhenium to enhance rigidity, strength and creep resistance thereof.

7. A method of manufacturing of a filament usable as an emission source in a scientific instrument comprising:

A. providing of Rhenium powder;

B. providing of Yttria initially as Yttrium Nitrate, namely, $Y(NO_3)_3.6H_2O$;

C. refining the Rhenium while simultaneously sintering the Yttria into the Rhenium to form a refined Rhenium and Yttrium alloy material, said provided Yttria being sintered into the provided Rhenium sufficiently during refining thereof to provide 0.01% to 10% volume percent Yttrium oxide in the final alloy, said refining of Rhenium while simultaneously sintering Yttria thereinto including forming a Yttrium oxide coated Rhenium powder having overall concentrations of Yttrium Oxide ranging between 0.01% and 10% wherein the final alloy has a final crystallite grain size finer than generally pure Rhenium to enhance rigidity, strength and creep resistance thereof; and D. drawing down the Rhenium alloy into a wire form for use in making various configurations of emission filaments.

* * * * *